United States Patent [19]

Brock

[11] Patent Number: 4,977,756

[45] Date of Patent: Dec. 18, 1990

[54] EVAPORATIVE AIR COOLER

[75] Inventor: James A. Brock, Alexander, Ark.

[73] Assignee: Walton Enterprises, Inc., Bentonville, Ark.

[21] Appl. No.: 465,996

[22] Filed: Jan. 16, 1990

[51] Int. Cl.[5] ..... F28D 5/00

[52] U.S. Cl. ..... 62/314; 261/29; 261/105; 261/106

[58] Field of Search ..... 62/304, 310, 314; 261/29, 105, 106

[56] References Cited

U.S. PATENT DOCUMENTS

| | | | |
|---|---|---|---|
| 2,741,105 | 4/1956 | Stratton | 62/314 |
| 3,151,188 | 9/1964 | Weatherston et al. | 261/29 |
| 3,385,352 | 5/1968 | Engalitcheff, Jr. et al. | 62/310 X |
| 4,043,777 | 8/1977 | Parren | 261/29 X |
| 4,323,373 | 4/1982 | Fritz | 261/106 X |
| 4,361,525 | 11/1982 | Leyland | 62/314 X |
| 4,428,890 | 1/1984 | Harrell | 261/106 X |
| 4,602,487 | 7/1986 | Seeley | 62/304 |
| 4,798,060 | 1/1989 | Long | 62/304 X |

*Primary Examiner*—William E. Tapolcai
*Attorney, Agent, or Firm*—Stephen D. Carver

[57] ABSTRACT

A highly efficient, multi-stage evaporative air cooler for either residential or commercial applications comprises an internal air pathway traversing an evaporative pad more than once. The cooler comprises an upright free-standing cabinet having an air inlet and a frontal surface through which cooled air is discharged. A rigid cage disposed internally within the cabinet comprises a rigid front plate and a separator plate which divides the cage into separate compartments. The periphery of the cage is completed by a pad support mesh, comprising a grid-like wire wall extending around and between the front plate edges and about the separator plate. An absorbent evaporative pad surrounding the cage adjoins and is supported by the pad support mesh. An internal annular boundary volume defined between the cage and the interior walls of the cabinet establishes fluid flow communication between the separate cage compartments. A fan and a blower motor assembly are secured to the separator plate within the cage. The air path traverses the evaporative media pad twice. Air sucked through the top of the cabinet enters the first cage compartment and cools the motor therewith. Air is drawn out of this upper cage compartment through the evaporative media and the cage walls into the boundary annulus. Air is drawn through the evaporative pad into the second cage compartment, and it is forced outwardly through the fan.

36 Claims, 6 Drawing Sheets

EVAPORATIVE AIR COOLER

BACKGROUND OF THE INVENTION

This invention relates generally to evaporative air coolers. More particularly, the present invention relates to efficient, generally upright and compact evaporative air conditioning units designed for residences, offices, or the like.

Evaporative air coolers are well known in the prior art. Typical evaporative coolers intake ambient air and pass it through a wetted pad to provide cooling. When water evaporates, heat is removed from the air in quantities related to the latent heat of vaporization. Cooling is proportional to a variety of well known factors such as air temperature, the relative humidity, the wet bulb depression, air speed, water temperature and other factors. A variety of absorbent mats such as trickle pads and excelsior pads have been employed in the art. A suitable inlet provided in a typical evaporative cooling unit admits air into the system in response to fan system suction. The air stream is routed through the water absorbent mat and is cooled by evaporation. As the air is cooled its humidity increases according to well known principles. Of course water must be periodically added to evaporative coolers to keep them functional.

Evaporative coolers are particularly useful in areas of relatively low humidity, which are characterized by relatively high wet bulb depressions. Wet bulb depression is calculated by subtracting the wet bulb temperature of ambient air from the dry bulb temperature measured at substantially the same time. In an evaporative air cooler air temperature is lowered when the latent heat of vaporization of water is extracted from the air according to well known principles. However, the efficiency of conventional evaporative coolers is normally in the area of fifty-five to sixty-five percent. The closer the unit's measured output air temperature is to the wet bulb temperature of untreated ambient air, the greater the achieved efficiency. Of course in an evaporative air cooler the output air theoretically cannot be cooled more than the wet bulb point. The amount of cooling is then divided by the depression, and the result is multiplied by 100 percent. By way of example, if the observed depression is ten degrees, and the air exiting the cooler has been cooled six degrees, then that device has exhibited an efficiency of sixty percent.

U.S Pat. No. 4,026,971 issued May 31, 1977 to Glascoe discloses a "round" evaporative cooler having a circular evaporation pad surrounding a blower. Air drawn into the apparatus through the pad is forced downwardly through the discharge mouth of the fan. Another cylindrical evaporative cooler is seen in U.S. Pat. No. 4,428,890. This device discloses a round or cylindrical evaporative cooler having a somewhat circular porous pad for distributing water. Another "cylindrical" evaporative air cooler is seen in U.S. Pat. No. 4,428,890 issued to Harrell on Jan. 31, 1984. Engel U.S. Pat. No. 3,975,470 issued Aug. 17, 1976 replaces the well-known prior art "cylindrical" water pad with a generally elongated and rectangular evaporator pad.

Goettl U.S. Pat. No. 3,400,185 discloses a generally cubical evaporative cooler in which a motor-driven fan is disposed interiorly of the cubical enclosure, and which draws air in through a generally horizontally disposed, rectangular pad. Air drawn through the pad is forced outwardly through a peripheral, open mesh grill. U.S. Pat. No. 4,452,615 issued June 5, 1984 discloses an air conditioning system in which a squirrel cage system disposed interiorly of a rigid enclosure draws air through a plurality of parallel filter media for cleaning and then humidifying the air. U.S. Pat. No. 4,029,723 issued to Morrison on June 14, 1977 discloses an arrangement of panels which inter-fit together to aid in the manufacture of the device.

A variety of different evaporative coolers have been suggested previously for vehicles. Generally rectangular systems are numerous, and a variety of generally cylindrical or "round" designs exist as well. Known evaporative air coolers may direct the air flow through horizontally disposed, generally planar water absorbent pads, through rectangular, vertically disposed pads, or through curved, encircling pads. The air may be drawn into the cooler and forced outwardly through peripheral side walls, or the process may be reversed, drawing the air in through the side walls and out through ducts which penetrate the side walls. Ducts may also be colinear with the axis of the shroud.

Representative of automotive evaporative coolers is U.S. Pat. No. 3,372,911 issued to Herboldsheimer on Mar. 12, 1968. The latter unit is adapted to be mounted upon the roof of a cab of a vehicle and is designed to handle dust and the shifting of water in response to vehicle movement. Representative of typical automotive evaporative coolers is U.S. Pat. No. 3,552,097, issued Jan. 5, 1971. The latter apparatus may be mounted in the top of a vehicle cab or the like. Air is drawn in through the periphery of the shroud by a rotating fan, and it is forced into the motor plenum through a radially surrounding peripheral filter. Processed or cooled air is thus forced out through the filter, and means are provided to circulate the water from a lower reservoir up into the filter region.

Nagele U.S. Pat. No. 3,867,486 attempts to direct air flow substantially uniformly through a surrounding filter pad. U.S. Pat. No. 3,978,174 issued to Peer on Aug. 31, 1976 discloses a typical evaporative cooler apparatus in which an internal motor draws air through the periphery of the apparatus and passes it through a surrounding filter member. Means are provided for splashing water upon the filter member. Air is thus forced by the motor directly down through the center of the apparatus and into peripheral outlets.

Paulus U.S. Pat. No. 2,752,143 includes a central fan unit disposed within a circular shroud of water absorbent material. U.S. Pat. No. 4,798,060 discloses an automotive evaporative air cooler in which the evaporative pad forms the evaporative impeller, and is thus rotated by the fan to force air through the system. A typical generally tubular water pad disposed in encircling relation with respect to a centered fan assembly is seen in U.S. Pat. No. 3,583,174.

A portable evaporative air cooler is seen in F. D. Davidson U.S. Pat. No. 2,769,620. It comprises a generally cylindrical shroud having an interior in which a motor driven fan is concentrically disposed. The fan is disposed within the compartment surrounded by a porous, water excelsior pad through which air is forced by the rotating fan. Air is drawn into the compartment interior through a plurality of vents defined in the periphery of the housing, and it is forced through the pads so that evaporation and humidification occur. The cooled, humidified air is outputted through the top of the apparatus.

U.S. Pat. No. 4,793,152 discloses an evaporative air cooler in which intercommunicating canals and water pathways attempt to precool the air. U.S. Pat. No. 3,348,830 combines evaporative cooling with scrubbing of air. Air to be cleaned is directed through a spiral scrubbing zone where it is subjected to spraying.

Biesemeyer U.S. Pat. No. 4,649,000 issued Mar. 10, 1987 discloses an evaporative cooler which sucks air in through an associated, rotatable generally horizontally disposed chamber. The rotatable, tube like chamber is formed of a water absorbent material, and air drawn through its periphery as it rotates through a water bath is cooled by evaporation through subsequent discharge by a squirrel cage fan.

Another patent which discloses structure relevant to the assembly of evaporative cooler frames and beds is U.S. Pat. No. 4,443,386 issued Apr. 17, 1984. Sealy U.S. Pat. No. 4,338,264 discloses an evaporative air cooler in which a tray like arrangement is employed for handling the water flow to a water pad which covers a squirrel cage fan system.

Less relevant references include U.S. Pat. Nos. 4,043,777; 4,351,781; 4,439,375; 4,752,419; 4,309,365; 3,273,867; 3,698,158; 4,713,943; 3,188,007; 3,365,181; 4,158,679; and 4,774,030.

However, all known prior art evaporative air coolers are relatively inefficient. Inefficiency results from a variety of factors, most notably the internal air path established by the design. Complex air paths result in larger, less portable units. Residential coolers, for example, should be fairly compact and lightweight. And, since typical units must be filled with water often, that task should be made relatively simple. I have discovered a unique internal geometry for evaporative air coolers. By properly positioning a motor system relative to the associated fan within a cage surrounded by a circumferential evaporative pad media, the cage is divided into separate isolated compartments. An air flow path which twice forces air through the water absorbent media results. Motor heat is added to the dry ambient air entering the unit. While compactness is preserved, efficiency is increased and the unit is easy to fill.

SUMMARY OF THE INVENTION

The present invention comprises a highly efficient multistage evaporative air cooler adapted to be employed in either residential or commercial applications. The cooler is characterized by an efficiency greater than ninety percent, which is remarkable in view of the prior art.

The cooler comprises a vertically upright, decorative cabinet suitably positioned upon a supporting floor or surface. The cabinet includes a decorative top having an air inlet defined in it, and a frontal surface through which cooled air is ultimately discharged. A rigid cage disposed internally within the cabinet comprises a rigid front plate interiorly secured to the front of the cabinet, and a rigid, generally horizontally extending separator plate. The periphery of the cage is completed by a pad support mesh, comprising a grid-like wire wall extending around and between the front plate edges and about the separator plate. An absorbent evaporative pad surrounding the cage adjoins and is supported by the pad support mesh. The cage interior volume bounded by the pad support mesh and the front plate is divided into two substantially equal compartments which defined between the separation plate.

The somewhat annular, boundary volume defined within the cooler between the cage and the interior walls of the cabinet is important to establishment of the preferred cooling air path. The cage compartments are separated from one another, and air cannot traverse the separator plate. However, both compartments are in fluid flow communication with the boundary volume. A fan and an associated blower motor assembly are secured to the separator plate within the cage. Preferably the motor is disposed within the upper cage compartment, and the fan is disposed within the lower cage compartment. A suitable shaft extending through the separator plate couples the motor to the fan.

Through the construction disclosed, the air path traverses the evaporative media pad twice in response to the fan. Air sucked through the top of the cabinet enters the first cage compartment and cools the motor therewithin. Air is drawn out of this upper cage compartment through the evaporative media and the cage walls into the boundary annulus. Air is then drawn through the evaporative pad into the second cage compartment. Precooled air within the annulus is thus sucked through the pad one more time, in that region of the annulus bordering the lower cage compartment. Air is thus cooled again by passage through the evaporative media, and it is forced outwardly through the fan.

The fan comprises a shroud communicating directly with an outlet orifice on the face of the cabinet, so that cool air is forcibly disposed outwardly of the apparatus. Preferably the cabinet top includes a recessed edge which when assembled seals the periphery of the evaporative media. The evaporative media is wetted by an apertured and channeled groove defined within this ledge so that it is constantly wetted. A convenient fill tube accessible from the cabinet top extending downwardly into the cooler interior may be periodically watered by the user. A decorative cover completes the cabinet, and may be removed to expose the cooler top.

Thus an object of the present invention is to provide a highly efficient evaporative cooler.

Stated another way, it is a fundamental object of this invention to get the discharge air dry bulb temperature as near the ambient wet bulb temperature as possible, thereby resulting in maximum evaporative cooler efficiency.

Yet another object of the present invention is to provide an air transfer path within an evaporative cooler which travels through the evaporative media more than once.

Similarly, it is an object of the present invention to provide an evaporative air cooler of the character described which, through unique internal geometry, establishes an air path which traverses the water absorbent pad twice, while preserving unit compactness.

Thus a primary object of the present invention is to provide an enclosure for an evaporative air cooler of the character described which divides the interior into suitable compartments providing paths for directing air through the evaporative media twice.

Another object of the present invention is to provide a system of the character described wherein heat from the fan motor is added to the relatively dry air immediately upon entering the apparatus.

Another basic object of the present invention is to provide a multi-compartmentalized evaporative cooler of the character described capable of use within the round or cylindrical type of mechanically efficiently housed systems.

A still further object of the present invention is to provide an evaporative cooler design which can be employed in conjunction with either down draft or side draft models.

Another object of the present invention is to add heat to the air stream prior to passing the air through the evaporative media. It is a feature of the present invention that heat from the motor itself, which must eventually be discharged within the environment in which the cooler is disposed, is added to the incoming warm ambient air. In a twin stage system of the character described it would also be possible to add the heat after precooling the air, but I have discovered because of the physics involved the overall efficiency is increased by adding heat to the warm air rather than adding heat to the cooled air.

Another object is to provide a residential evaporative air coolers of the character described which is compact and lightweight.

Yet another object is to provide a cooler of the character described which may be easily filled with water.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
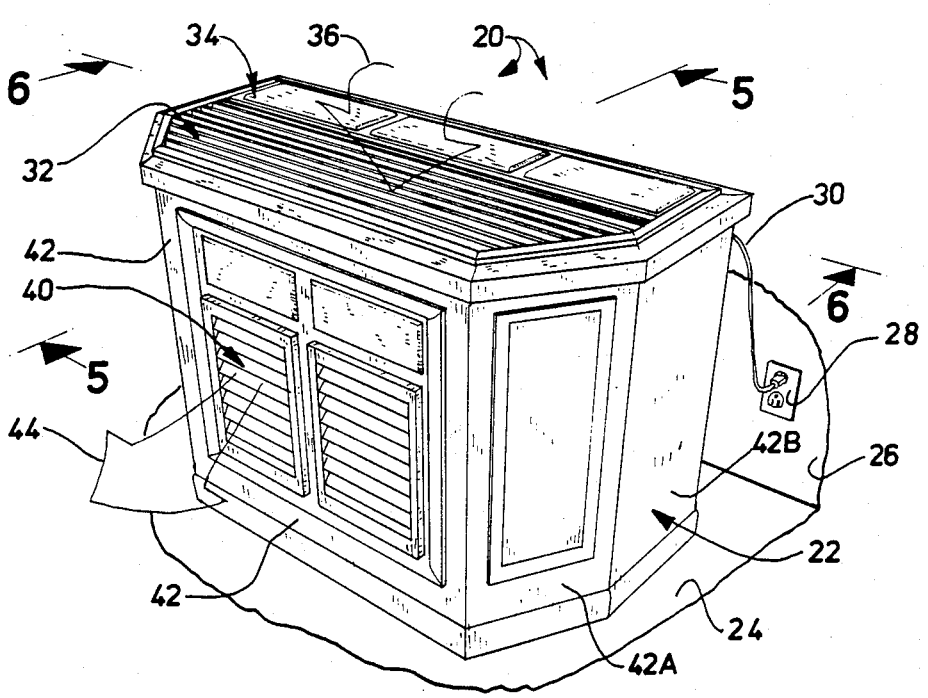
FIG. 1 is a fragmentary pictorial view showing the best mode of my Evaporative Air Cooler.
Figure 2:
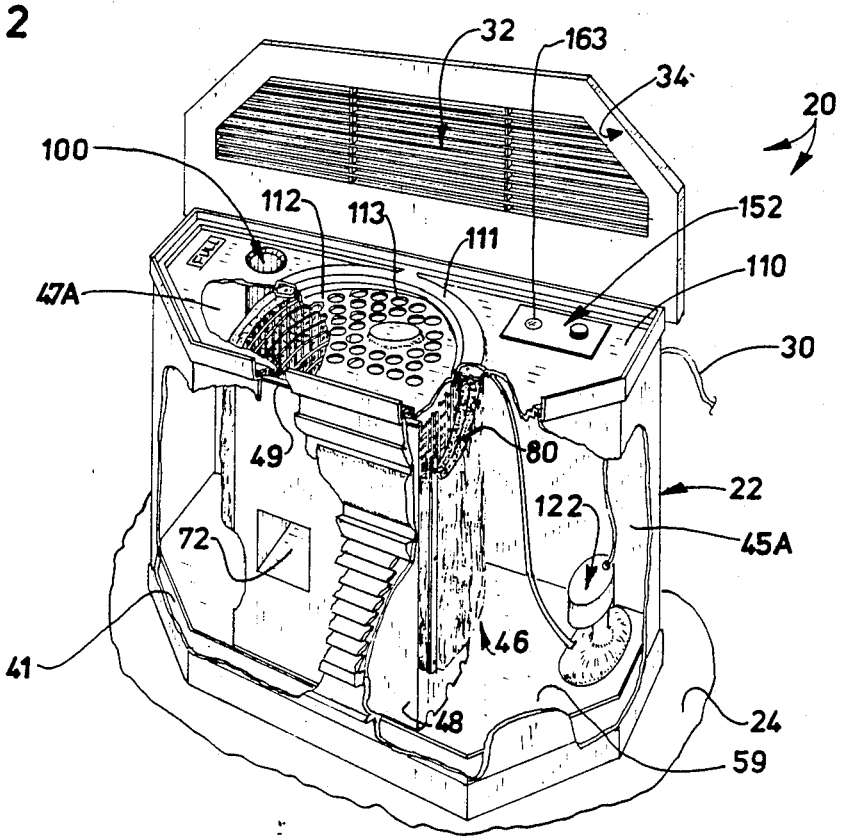
FIG. 2 is a fragmentary, perspective view of the Evaporative Air Cooler with portions thereof moved, broken away, or shown in section for clarity.

With initial reference now directed to FIGS. 1–5 of the appended drawings, an evaporative air cooler constructed in accordance with the teachings of the present invention has been generally designated by the reference numeral 20. Evaporative cooler 20 comprises a generally cubical, decorative cabinet 22 adapted to be disposed upon a supporting surface such as floor 24. Cabinet 22 is ideally placed adjacent a wall 26 having a conventional outlet 28 for the supply of electricity via a conventional power cord 30. A decorative cover 34 may be removed to expose the cabinet interior. In operation ambient air is drawn into the cooler through louvers 32 in cabinet cover 34, as indicated generally by arrow 36 (FIG. 1). Louvers 40 defined in the cabinet front grill 42 discharge cooled air, as indicated pictorially by arrow 44 (FIG. 1). The various louvers may be adjustable, so that users may direct the air flow as described. Cooling is effectuated by drawing air through an air path which traverses wetted a evaporation pad disposed within the cabinet.

Cabinet 22 is preferably comprised of plastic, and it may take on a variety of configurations. In the best mode it comprises a pair of diverging sidewalls 42A which are integral with grill 42 and which integrally intersect cabinet sides 42B. A generally planar cabinet back 45 having an interior surface 45A. An offset, interior floor 59 extends between the opposite cabinet side walls (42A, 42B) and between the front grill 42 and the cabinet back 45. This sealed, internal floor 59 provides a flat, interior support surface 59A. A cage assembly, generally designated by the reference number 46 (FIGS. 7–9) is supported within the cabinet in contact with a head of water upon floor surface 59A. A lower void 41 (FIGS. 5, 6) is defined beneath the floor 59 of the cabinet, and it is sufficiently spaced apart from floor 24 to minimize the formation of condensation.

Figure 7:
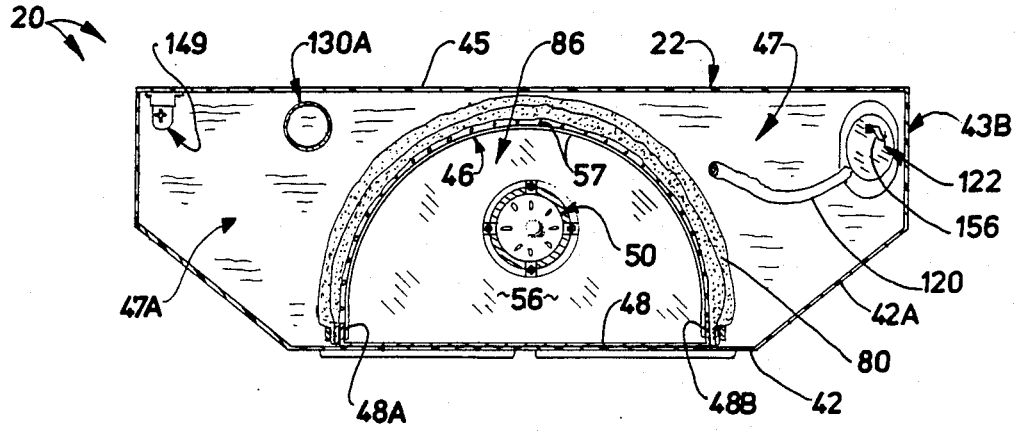
FIG. 7 is a fragmentary, vertical, sectional view taken generally along line 7—7 of FIG. 6.
Figure 8:
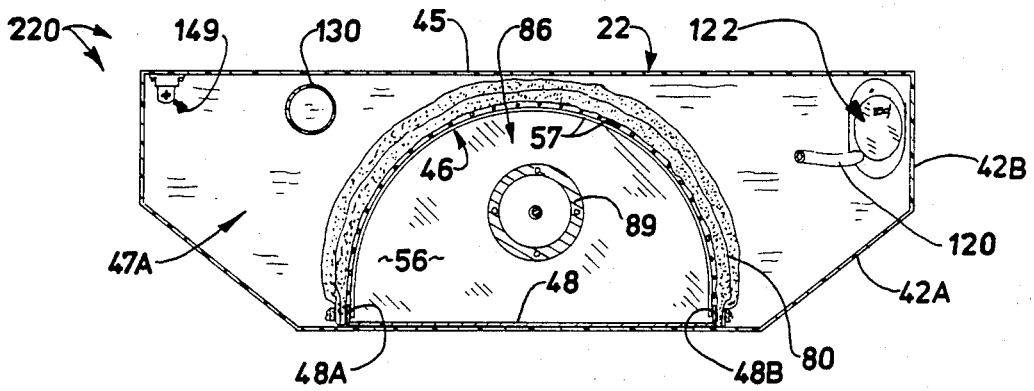
FIG. 8 is a fragmentary, vertical, sectional view taken generally along line 8—8 of FIG. 6; and, FIG. 9 is a fragmentary, vertical, sectional view taken generally along line 9—9 of FIG. 6.
Figure 9:
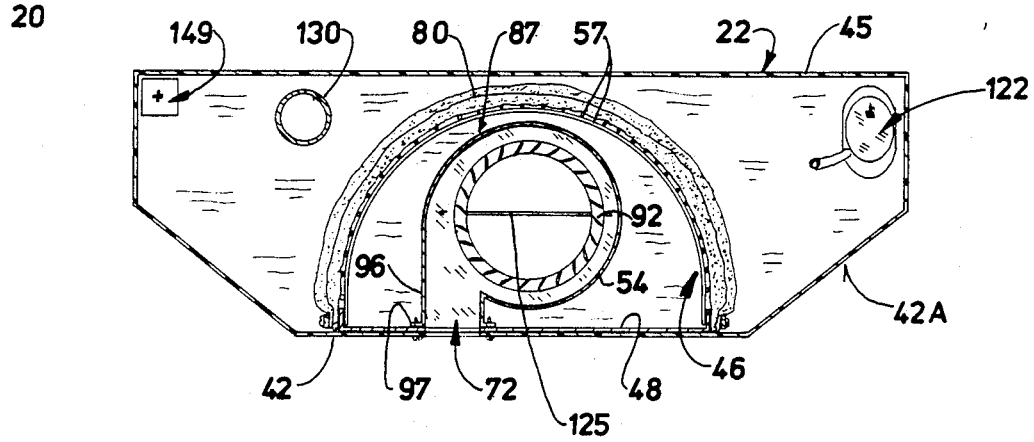

With additional reference now to FIGS. 7 through 9, the cage assembly, generally by the reference numeral 46, is housed and fastened within the hollow interior 47 of the cabinet 22. Cage assembly 46 encloses and mounts the system motor 50 and the associated blower assembly 52, and it supports a peripheral evaporative pad through which air passes for cooling. In the best mode the blower assembly comprises a forward curved blower wheel.

It will be appreciated that the cage assembly 46 may take on a variety of different configurations. In the best mode the cage assembly is somewhat cylindrical. It comprises a rigid, generally planar cage plate 48 of generally rectangular dimensions, which forms a front of the cage assembly. The top of the cage plate comprises an outwardly depending flange 49 for mounting against a suitably configured recess defined in the plastic cabinet. Cage plate 48 supports a flat, rearwardly projecting separator plate 56 (FIG. 8) to which the motor and fan assembly are operatively mounted. Separator plate 56 comprises a lip 55 which is fastened to cage plate 48. Plate 56 projects away from and intersects plate 48. Separator plate 56 projects horizontally toward the periphery of the cage generally designated by the reference numeral 58. As will be explained in detail hereinafter, the separator plate divides the interior of the cage assembly into two separate compartments.

Figure 4:
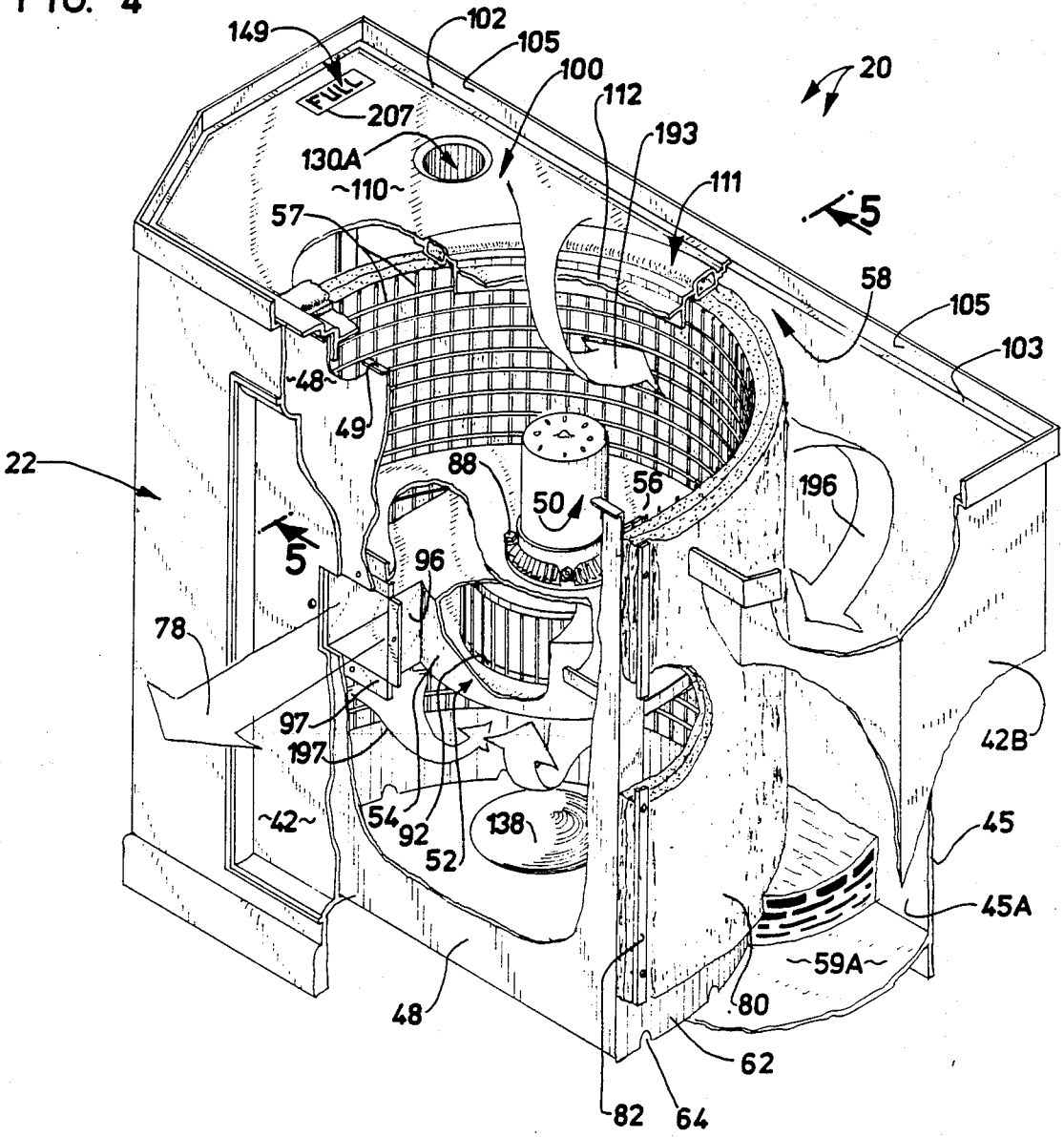
FIG. 4 is an enlarged, fragmentary, isometric view primarily illustrating the interior of the cooler with portions thereof broken away or shown in section for clarity.

A pad support mesh 57 extends about the periphery 58 of the cage assembly. The edges of mesh 57 are fastened to opposite flanged sides 48A and 48B of the cage plate 48. The grill-like pad support mesh 57 is substantially semi-circular in cross section. It is reinforced by intersection with a circumferential flanged peripheral lip 60 (FIG. 5) formed at the outer semicircular periphery of the separator plate 56. The lower portion of the peripheral mesh 57 is securely fastened to the fence-like, sheet metal cage bottom 62 (FIG. 4). At this time the pad support mesh is preferably comprised of galvanized metal, but it could be favorably designed from other corrosion resistant materials such as plastic. The separator plate 56 is preferably spot-welded to the cage plate in generally perpendicular relation thereto and is disposed approximately half way between the cage plate top and the cage plate bottom.

The bottom 62 of the cage assembly rests directly upon the exposed, inwardly facing surface 59A of the cabinet floor 59. The cage bottom comprises a plurality of optional, radially spaced apart notches 64 for admitting water into the lower interior of the cage. As best viewed in FIG. 3, the cage plate 48 is preferably fastened to the cabinet front 42 by a plurality of conventional screws 66 which penetrate suitable predefined cabinet orifices 67 and engage orifices 69 (FIG. 3) in cage plate 48. Cage plate 48 will smoothly abut the inner surface of the cabinet wall 42 when the cage assembly is properly installed. At this time the cage bottom 62 will abut the upper inner surface 59A of the cabinet floor 59. When so assembled, an output orifice 72 (FIGS. 3,4) will register with orifice 74 defined in cabinet face 42 so that air may exit from the apparatus as indicated generally by arrow 78.

The outer periphery 58 of the cage assembly is substantially surrounded by abutting water absorbent pad 80. Pad 80 is preferably comprised of a pair of individual adjoining layers 80A and 80B (FIG. 5A) of conventional evaporative pad media. Suitable evaporative pad materials are also known as "Excelsior" media or "Aspen" padding. Pad 80 overlies the mesh 57, and extends approximately between cage bottom 62 and the cage top, being fastened at the opposite edges of the cage plate 48 by elongated retainer flanges 82. Air passes through pad 80 twice on its way through the cooler. The pad is wetted both from the top and the bottom. A supply of water is disposed within the cabinet.

Figure 6:
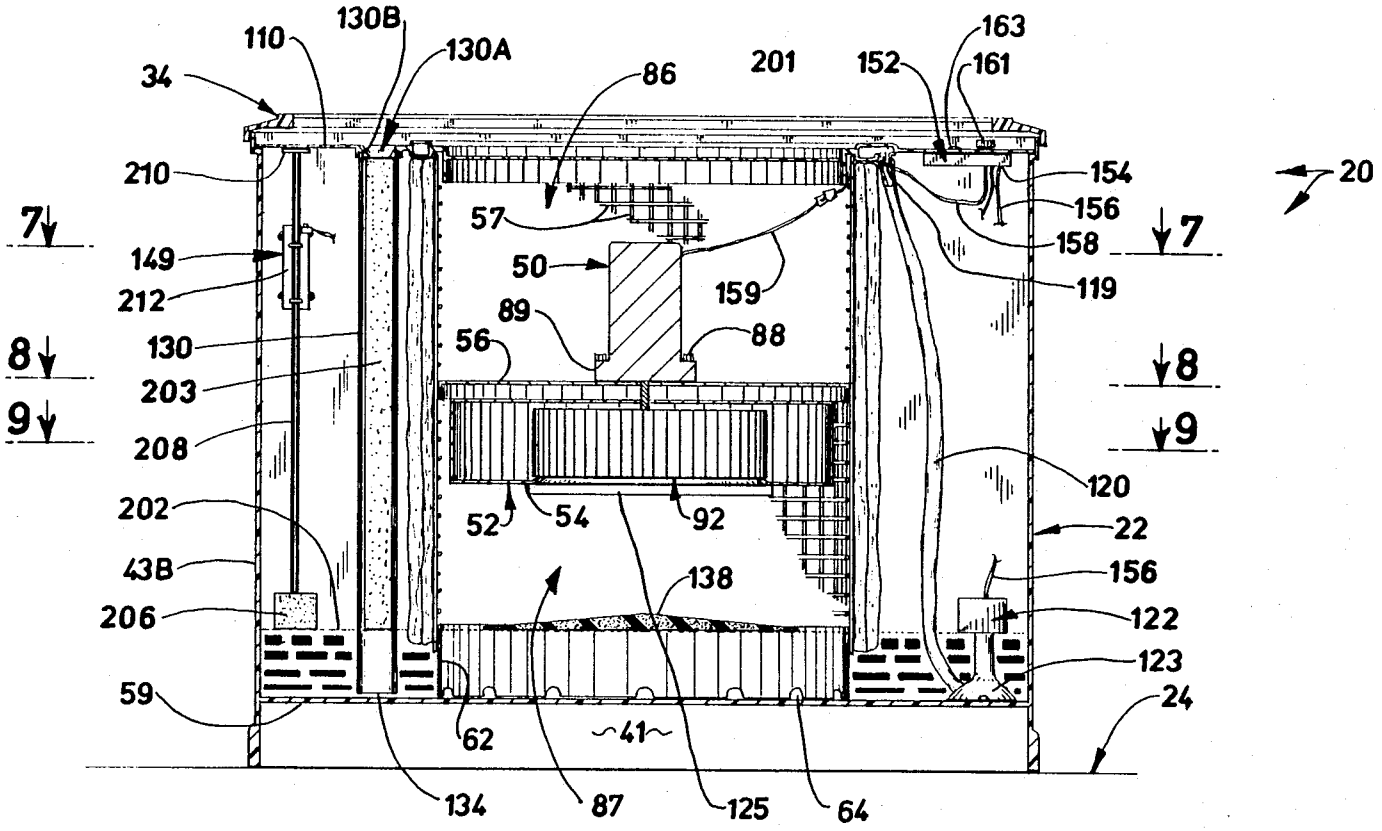
FIG. 6 is a fragmentary, longitudinal sectional view take generally along line 6—6 of FIG. 1.

The generally planar separator plate 56 thus projects horizontally interiorly of the cage. As mentioned, its outer peripheral edges mate with the mesh 57, and thus the internal volume bounded by the periphery of the pad support mesh 57 and the cage plate 48 is divided into a first, upper compartment 86 and a second lower compartment 87 (FIG. 6). The upper compartment 86 is defined between the top of the cage and the separator plate 56. The lower compartment 87 is defined between the bottom of the separator plate 56 and the floor 59 of the cabinet. Air passage directly between compartments 86 and 87 is prevented by separator plate 56. Air cannot travel between these two compartments without first traversing a third compartment defined between the cage assembly and the cabinet, as will be explained in detail hereinafter.

Motor 50 comprises a conventional electrical drive motor and is mounted to and centered upon plate 56. It is secured by conventional bolts 88 which secure mounting flange 89. Motor 50 mechanically drives the blower assembly 52 via a shaft (not shown) which penetrates the separator plate. Assembly 52 comprises a rotary fan blade 92 disposed within a conventional blower housing 54. Housing 54 is in fluid flow communication with an output duct 96. Optional flanges 97 may be suitably fastened to cage plate 48 (FIG. 4) in surrounding relation with respect to orifice 72 (FIG. 3).

With concurrent reference now to FIGS. 3, 4 and 7-9, that portion of the interior volume of the cabinet between the cabinet walls and the cage assembly has been generally designated by the reference numeral 47A. The top of cage assembly 46 and thus the upper compartment 86 is isolated from the cabinet interior portion 47A (FIGS. 7-9). Proper isolation of the upper cage assembly compartment from the cabinet interior 47, 47A is accomplished by the molded, cage sealing lid 100 which actually mates to the top of the cabinet and is positioned below the decorative cover 34. Lid 100 is shaped to fit directly over the cage between the uppermost top edges of the cabinet, to which it is held by suitable fasteners, preferably screws.

Figure 3:
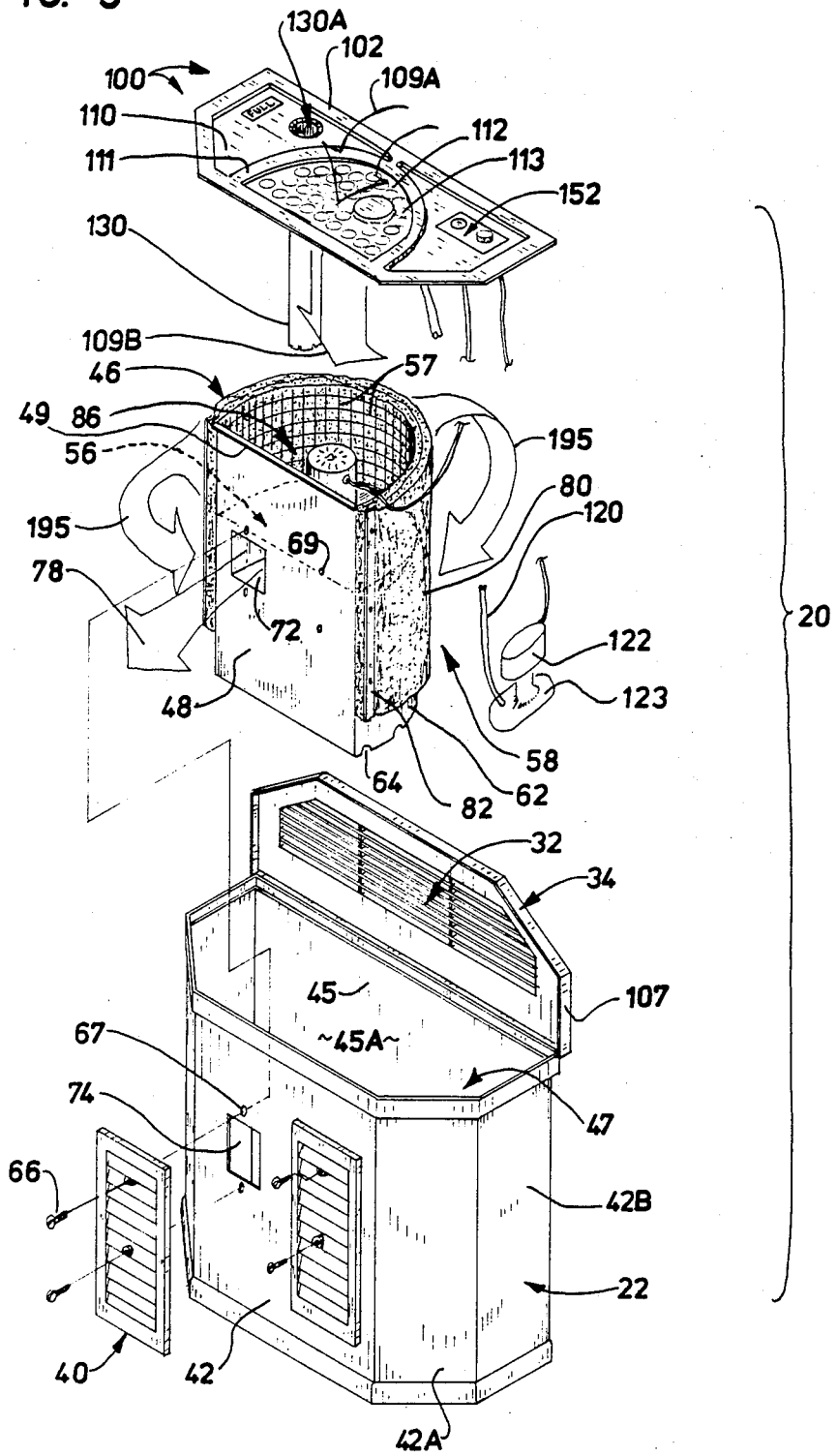
FIG. 3 is an fragmentary, exploded, isometric view of the cooler.
Figure 5:
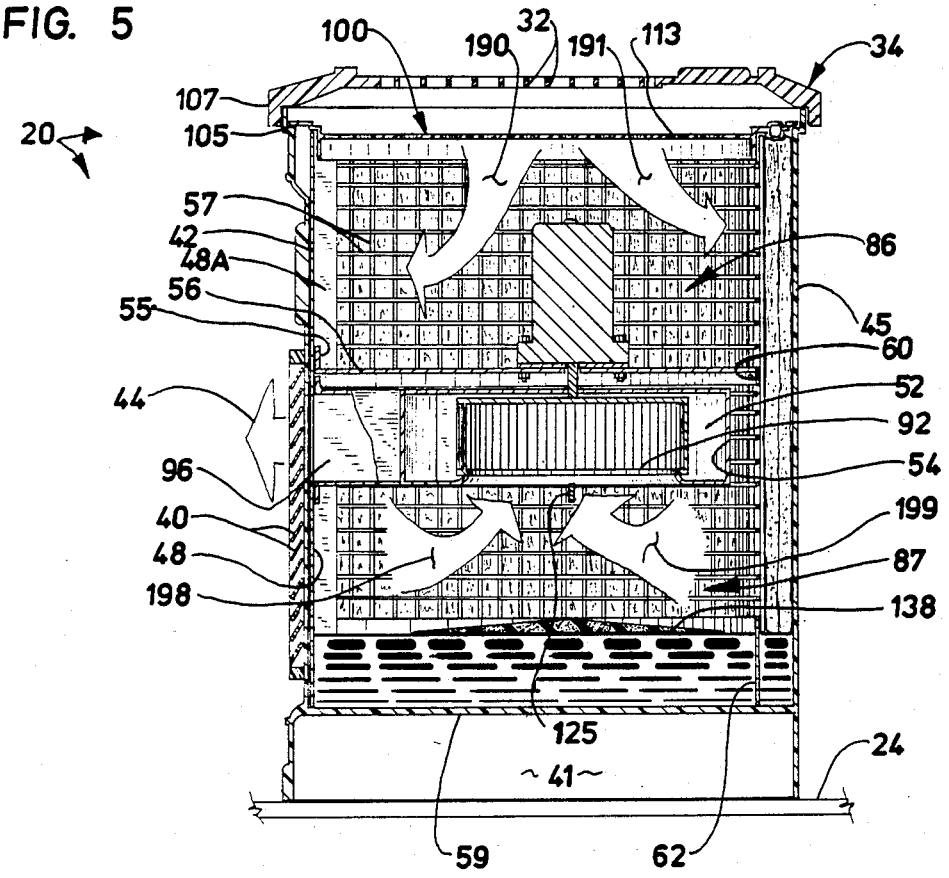
FIG. 5 is an enlarged, fragmentary, sectional view taken generally along line 5—5 of FIG. 1.
Figure 5A:
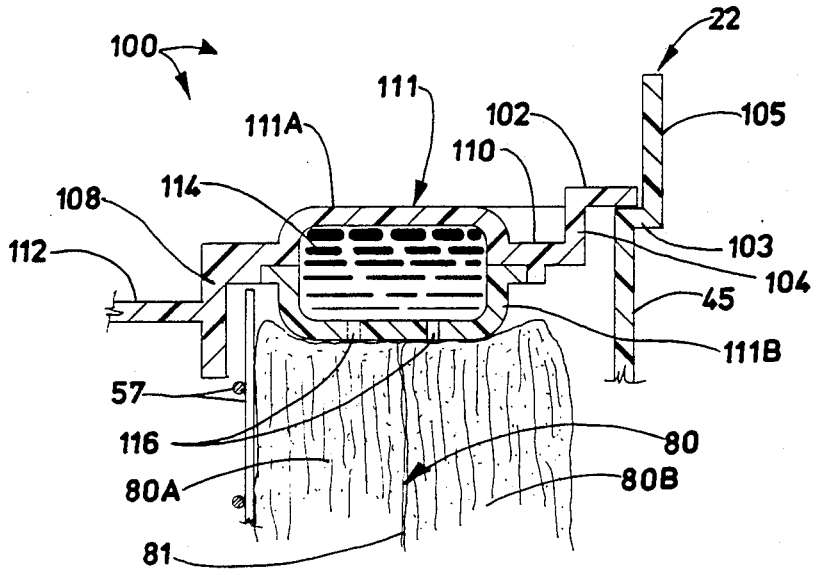
FIG. 5A is a greatly enlarged, fragmentary, sectional vie showing the upper right corner of FIG. 5 in detail.

With primary reference now directed to FIGS. 3, 4 and 5A, the internal cage sealing lid 100 preferably comprises a peripheral flanged edge 102 integral with a downwardly projecting portion 104 which offsets the major surface portion 110 of the lid. Edge 102 rests upon shoulder 103 formed at the junction of wall 45 with upper lip 105. In assembly lip 105 mates with a downwardly projecting peripheral flange 107 associated with the removable cover 34. A trough-like water distribution channel 111 is disposed between lid surface 110 and the lower, offset vented lid surface 112, which is offset from surface 110 by integral leg 108. Channel 111 is generally rectangular in cross-section and consists of an integral top 111A and a separate bottom 111B which is snap-fitted and glued thereto. The spaced apart outlet holes 116 defined in bottom 111B distribute water 114 to filter pad 80, which is aligned with and spaced below channel 111, with the boundary region 81 between the twin pad layers 80A and 80B circular to register properly with the cage assembly.

Pad support mesh 57 is captured between channel 111 and downwardly projecting leg 108 which circumscribes the periphery of apertured lid surface 112. Lid surface 112 comprises a plurality of inlet orifices 113 for admitting air into the interior of the cage. Water is transmitted to channel 111 through a suitable plastic fitting 119 (FIG. 6) which is interconnected with a water supply hose 120. Hose 120 is supplied by a conventional pump 122 disposed adjacent the cage assembly within the cabinet upon floor 59.

As seen in FIG. 6, the reference numeral 202 indicates the preferred initial water level. The sealing lid 100 is connected to a vertical water fill pipe 130 which extends from an upper inlet orifice 130A to a lower outlet 134 near the cabinet floor 59. Outlet 134 is normally immersed in water in operation. As water begins to fill the bottom of the cabinet, it may pass through the cage assembly bottom 62, rising within the cabinet bottom. The inlet 123 of pump 122 will be immersed as water fills the lower chamber 87. As explained in more detail hereinafter, air will be drawn through the evaporative pad from cabinet volume 47A and will enter the blower assembly immediately beneath the fan (as viewed in FIG. 6). Turbulence which thus results may stir up the water head considerably. For this reason an optional circular, disk-like splash guard 138 may be floated beneath the fan assembly air intake to prevent agitated water from being sucked directly into the fan. However it is preferred that an elongated, flat anti-vortex plate 125 (FIGS. 6 and 9) is disposed immediately beneath the blower inlet.

Water level is monitored and established by a float system. An optional cylindrical styrofoam float 203 concentrically disposed within the fill tube 130 may be floated by the head of water. As the water approaches the desired maximum level, float 203 blocks inlet 130A preventing overfill. Further rising of float 203 is prevented by flanges 130B of inlet orifice 130A.

Water level is further monitored by a fill indicator generally designated by the reference numeral 149 associated with sealing lid surface 110. A float 206 controls a rod 208 which supports a flag 210. Bracket 212 constrains rod 208. The upper side of flag 210 is marked to indicate "full," as seen in FIG. 4, and flag 210 is visible through window 207 in lid 100 when the water fill level is proper.

The electrical control system is generally designated by the reference numeral 152. Control box 154 is interconnected with the conventional wall outlet 28 (FIG. 1) by cord 30. Power is transmitted to pump 122 by cord 156 and power is transmitted to motor 50 via lines 158 and 159 (FIG. 6). Knob 161 adjacent fill indicator light 163 can be adjusted to control motor and fan speed.

When the decorative cabinet cover 34 is placed upon the cooler, its louvers 32 will admit air directly in through the orifices 113 in lid 100. Thus arrow 36 in FIG. 1 indicating the incoming air forms the beginning of the air path, which continues with arrows 109A, 109B (FIG. 3). Air thus enters the upper cage compartment 86, and physically contacts the motor 50. The motor is thereby cooled. With concurrent reference to FIGS. 4 and 5, Arrows 190, 191 and 193 figuratively indicate the admission of air into cage compartment 86.

Air is drawn through the evaporative pad 80, and exits from the upper cage compartment 86 into the cabinet interior region, 47A (FIGS. 7 through 9), and figuratively represented by the arrow 196 (FIG. 4). Air within the cabinet but outside of the cage assembly cannot go anywhere other than back into the cage assembly lower compartment 87, again traversing the evaporative pad 80. Air will thus pass from the cabinet interior through pad 80 back into the cage, entering the lower cage compartment 87. This has been generally designated by the arrows 198 and 199 in FIG. 5 and arrow 197 in FIG. 4. Resultant turbulence within the lower cage compartment 87 is suppressed primarily by vortex suppressing plate 125, and optionally by disk 138.

Air will be drawn upwardly into the bottom of the blower assembly, and it will be forced out of the blower assembly directly through the duct 96, resulting in airflow as indicated by arrow 78 (FIG. 4) and 44 (FIG. 5). Thus the air paths between arrows 36 and 44 of FIG. 1 comprise passage through the upper cage compartment, the generally annular surrounding volume of the cabinet, into the lower cage compartment and into the blower assembly for direct ejection forward of the cabinet.

Thus, through the geometric configuration shown cooling efficiency is greatly enhanced. However, it should be recognized that the exact configuration may vary. The motor and fan, for example, may be located outside of the illustrated cage compartments.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An evaporative air cooler comprising:

an air inlet and an air outlet;

a hollow cabinet adapted to be disposed upon a supporting surface;

a cage adapted to be disposed within said cabinet, said cage comprising an inner volume divided into first and second separate compartments;

a boundary volume defined within said evaporative air cooler between said cage and said cabinet;

fan means for moving air through said cooler;

motor means for driving said fan means;

evaporative pad means associated with said cage;

an air path established through said air inlet into one of said first or second cage compartments, through said pad into said boundary volume, through said pad again into the other of said first or second cage compartments, and out of said cooler through said outlet; and, said cabinet comprising a cabinet top adapted to be fitted against said cage, said top comprising said air inlet, and said air inlet being in fluid flow communication with said first cage compartment.

2. The evaporative air cooler as defined in claim 1 wherein said fan means is disposed in one of said first or second cage compartments and said motor means is disposed in the other of said first or second cage compartments.

3. The evaporative air cooler as defined in claim 2 wherein said cooler comprises separator plate means for dividing said cage into said first and second separate compartments, said first compartment is above said second compartment, and said motor means is disposed within said first compartment upon said separator plate.

4. The evaporative air cooler as defined in claim 3 wherein said fan means is disposed within said second compartment and exhausts directly to said air outlet.

5. The evaporative air cooler as defined in claim 3 wherein said cage comprises:

a bottom adapted to be disposed within a head of water stored within said cabinet;

a top spaced apart from said bottom;

a rigid frame plate extending between said top and said bottom; said frame plate comprising spaced apart edges; and, a pad support mesh extending between said cage edges forming a cage periphery.

6. The evaporative air cooler as defined in claim 5 wherein said separator plate is secured to said frame plate in generally perpendicular relation thereto between said cage top and said cage bottom.

7. The evaporative air cooler as defined in claim 6 wherein said fan is disposed within said second cage compartment, said motor is disposed within said first cage compartment, said frame plate comprises an outlet orifice, and said fan means comprises an outlet shroud in fluid flow communication with said outlet orifice.

8. The evaporative air cooler as defined in claim 7 wherein said cage bottom comprises a plurality of water inlets.

9. The evaporative air cooler as defined in claim 7 wherein said cabinet top comprises a recessed ledge adapted to tightly fitted against said cage top.

10. The evaporative air cooler as defined in claim 9 wherein said cooler comprises a fill tube extending between said cabinet top within said boundary volume and having an end immersed in water.

11. The evaporative air cooler as defined in claim 10 including means for indicating the water level within said cooler.

12. An evaporative air cooler comprising:

a cabinet;
an air inlet and an air outlet;
wetted evaporative pad means within said cabinet through which air is drawn at least twice;
cage means disposed within said cabinet for supporting said evaporative pad means;
first and second separate compartments defined within said cage means;
fan means for moving air through said cooler;
motor means for driving said fan means;
said fan means disposed in one of said first or second cage compartments and said motor means disposed in the other of said first or second cage compartments;
a boundary volume defined between said cage means and said cabinet; and,
an air path commencing with said inlet, then entering one of said first or second cage compartments, passing through said evaporative pad means into said boundary volume, returning through said evaporative pad means into the other of said first or second cage compartments, and exiting said evaporative cooler through said outlet.

13. The evaporative air cooler as defined in claim 12 wherein said cooler comprises separator plate means for dividing said cage into said first and second separate compartments, said first compartment is above said second compartment, and said motor means is disposed within said first compartment upon said separator plate.

14. An evaporative air cooler comprising:
a cabinet adapted to be disposed upon a supporting surface;
an air inlet and an air outlet;
evaporative pad means within said cabinet for cooling air passing therethrough;
means for wetting said evaporative pad means;
cage means disposed within said cabinet for supporting said evaporative pad means;
first and second separate compartments defined within said cage means;
fan means disposed in one of said first or second cage compartments for moving air through said cooler;
motor means located in the other of said first and second compartments for driving said fan means;
a boundary volume defined between said cage means and said cabinet; and,
an air path commencing with said inlet, then entering one of said first or second cage compartments, passing through said evaporative pad means into said boundary volume, returning through said evaporative pad means into the other of said first or second cage compartments, and exiting said evaporative cooler through said outlet.

15. The evaporative air cooler as defined in claim 14 wherein said first and second cage means compartments are defined by a rigid separator plate, said motor means is disposed within said first compartment and mounted upon said separator plate, and said fan means is disposed within said second cage compartment and mounted to an opposite side of said separator plate.

16. The evaporative air cooler as defined in claim 15 wherein said sealing lid comprises a recessed portion adapted to firmly abut the top of said cage means, and said means for wetting said evaporative pad means is associated with said recessed portion.

17. The evaporative air cooler as defined in claim 16 wherein said means for wetting said evaporative pad means comprises means for directly engaging said cage means top, hose means associated with said last mentioned means for dispensing water upon said evaporative pad means, and means for pumping water through said hose means.

18. The evaporative air cooler as defined in claim 16 including anti-vortex means for preventing the intake of water into said fan means.

19. An evaporative air cooler comprising:
an air inlet and an air outlet;
a hollow cabinet adapted to be disposed upon a supporting surface;
a cage adapted to be disposed within said cabinet, said cage comprising an inner volume divided into first and second separate compartments;
a top fitted against said cage, said air inlet defined in said top in fluid flow communication with said first cage compartment;
a boundary volume defined within said evaporative air cooler between said cage and said cabinet;
fan means for moving air through said cooler;
motor means for driving said fan means;
evaporative pad means surrounding said cage; and,
an air path established through said air inlet into said first cage compartment, through said pad into said boundary volume, through said pad again into said second cage compartment, and out of said cooler through said outlet.

20. The evaporative air cooler as defined in claim 19 wherein said fan means is disposed in one of said first or second cage compartments and said motor means is disposed in the other of said first or second cage compartments.

21. The evaporative air cooler as defined in claim 20 wherein said cooler comprises separator plate means for dividing said cage into said first and second separate compartments, said first compartment is above said second compartment, and said motor means is disposed within said first compartment upon said separator plate.

22. The evaporative air cooler as defined in claim 20 wherein said fan means is disposed within said second compartment and exhausts directly to said air outlet.

23. The evaporative air cooler as defined in claim 20 wherein said cage comprises:
a bottom adapted to be disposed within a head of water stored within said cabinet;
a top spaced apart from said bottom;
a rigid frame plate extending between said top and said bottom; said frame plate comprising spaced apart edges; and,
a pad support mesh extending between said cage edges forming a cage periphery.

24. The evaporative air cooler as defined in claim 23 wherein said separator plate is secured to said frame plate in generally perpendicular relation thereto between said cage top and said cage bottom.

25. The evaporative air cooler as defined in claim 24 wherein said fan is disposed within said second cage compartment, said motor is disposed within said first cage compartment, said frame plate comprises an outlet orifice, and said fan means comprises an outlet shroud in fluid flow communication with said outlet orifice.

26. The evaporative air cooler as defined in claim 24 wherein said cabinet top comprises a recessed ledge adapted to tightly fitted against said cage top.

27. The evaporative air cooler as defined in claim 24 wherein said cooler comprises a fill tube extending between said cabinet top within said boundary volume and having an end immersed in water.

28. The evaporative air cooler as defined in claim 24 including means for indicating the water level within said cooler.

29. An evaporative air cooler comprising:

an air inlet and an air outlet;

a hollow cabinet adapted to be disposed upon a supporting surface;

a cage adapted to be disposed within said cabinet, said cage comprising an inner volume divided into first and second separate compartments;

a boundary volume defined within said evaporative air cooler between said cage and said cabinet;

fan means for moving air through said cooler, motor means for driving said fan means;

said fan means disposed in one of said first or second cage compartments and said motor means is disposed in the other of said first or second cage compartments;

evaporative pad means surrounding said cage; and, an air path established through said air inlet into one of said first or second cage compartments, through said pad into said boundary volume, through said pad again into the other of said first or second cage compartments, and out of said cooler through said outlet.

30. The evaporative air cooler as defined in claim 29 wherein said cooler comprises separator plate means for dividing said cage into said first and second separate compartments, said first compartment is above said second compartment, and said motor means is disposed within said first compartment upon said separator plate.

31. The evaporative air cooler as defined in claim 30 wherein said fan means is disposed within said second compartment and exhausts directly to said air outlet.

32. The evaporative air cooler as defined in claim 30 wherein said cage comprises:

a bottom adapted to be disposed within a head of water stored within said cabinet;

a top spaced apart from said bottom;

a rigid frame plate extending between said top and said bottom; said frame plate comprising spaced apart edges; and, a pad support mesh extending between said cage edges forming a cage periphery.

33. The evaporative air cooler as defined in claim 30 wherein said fan is disposed within said second cage compartment, said motor is disposed within said first cage compartment, said frame plate comprises an outlet orifice, and said fan means comprises an outlet shroud in fluid flow communication with said outlet orifice.

34. The evaporative air cooler as defined in claim 30 wherein said cabinet top comprises a recessed ledge adapted to tightly fitted against said cage top.

35. The evaporative air cooler as defined in claim 34 wherein said cooler comprises a fill tube extending between said cabinet top within said boundary volume and having an end immersed in 36. The evaporative air cooler as defined in claim 35 including means for indicating the water level within said cooler.

* * * * *